United States Patent [19]

Pauly et al.

[11] 4,193,639

[45] Mar. 18, 1980

[54] MOUNTABLE WHEEL FOR TOY VEHICLE

[75] Inventors: Ronald R. Pauly, Mound; Thomas W. Good, Long Lake; John D. Hastings, Eden Prairie; Kevin D. Ryan, Minneapolis, all of Minn.

[73] Assignee: Tonka Corporation, Spring Park, Minn.

[21] Appl. No.: 899,102

[22] Filed: Apr. 21, 1978

[51] Int. Cl.[2] ..... B60B 5/02; A63H 17/26

[52] U.S. Cl. ..... 301/9 DH; 46/221; 301/63 DS; 301/63 PW; 301/111

[58] Field of Search ..... 301/5.3, 5.7, 9 AH, 301/9 DH, 9 S, 63 D, 63 DT, 63 DS, 63 PW, 35 BJ, 111; 16/45–47, 98, 107; 46/221; 152/323, 412–413, DIG. 18

[56] References Cited

U.S. PATENT DOCUMENTS

| | | |
|---|---|---|
| 2,921,344 | 1/1960 | Carrico . |
| 2,940,781 | 6/1960 | Erikson . |
| 2,955,884 | 10/1960 | Marshall . |
| 2,973,226 | 2/1961 | Ellies . |
| 3,020,091 | 2/1962 | Solomon . |
| 3,048,447 | 8/1962 | Klint . |
| 3,062,254 | 11/1962 | Keefe . |
| 3,158,404 | 11/1964 | Noakes . |
| 3,214,220 | 10/1966 | Foster et al. |
| 3,218,757 | 11/1965 | Benkoe . |
| 3,263,363 | 10/1965 | Doe . |
| 3,321,863 | 5/1967 | Maxam, Jr. |
| 3,360,300 | 12/1967 | Carter . |
| 3,387,894 | 6/1968 | Louik . |
| 3,408,770 | 11/1968 | Smolinski et al. |
| 3,445,958 | 5/1969 | Johnson et al. |
| 3,566,536 | 3/1971 | Baynes et al. |
| 3,592,510 | 7/1971 | Hatfield . |
| 3,604,756 | 9/1971 | Gruber . |
| 3,611,630 | 10/1971 | Adickes et al. |
| 3,638,356 | 2/1972 | La Branche . |
| 3,642,048 | 2/1972 | Poweleit . |
| 3,646,706 | 3/1972 | Adickes . |
| 3,656,531 | 4/1972 | Ross et al. |
| 3,720,017 | 3/1973 | Ersilio . |
| 3,730,594 | 5/1973 | Zbikowski . |
| 3,733,744 | 5/1973 | Hiltpold et al. |
| 3,817,581 | 6/1974 | Maxam . |
| 3,894,776 | 7/1975 | Black . |
| 3,895,844 | 7/1975 | Merbler . |
| 3,907,370 | 9/1975 | Bard . |
| 3,924,352 | 12/1975 | Goldfarb et al. |
| 3,952,786 | 4/1976 | Kreling et al. |
| 3,985,392 | 10/1976 | Bergmann et al. |
| 4,114,952 | 9/1978 | Kimmell ..... 301/63 PW X |

FOREIGN PATENT DOCUMENTS

| | | | |
|---|---|---|---|
| 817083 | 10/1951 | Fed. Rep. of Germany | 152/413 |
| 445099 | 2/1949 | Italy | 301/5.3 |

*Primary Examiner*—Charles A. Marmor
*Attorney, Agent, or Firm*—Norman P. Friederichs

[57] ABSTRACT

A wheel suitable for use on toy vehicles. The wheel has a tire which is mountable and demountable with respect to such toy vehicle. The wheel includes a first member that is rotatably mounted in a permanent or semi-permanent arrangement on an axle. The wheel has a second member including a tire which is demountably supported on the first member. The first member has a locking mechanism which cooperates with a portion of the second member to prevent unintended rotation of the first member with respect to the second member.

8 Claims, 8 Drawing Figures

FIG. I
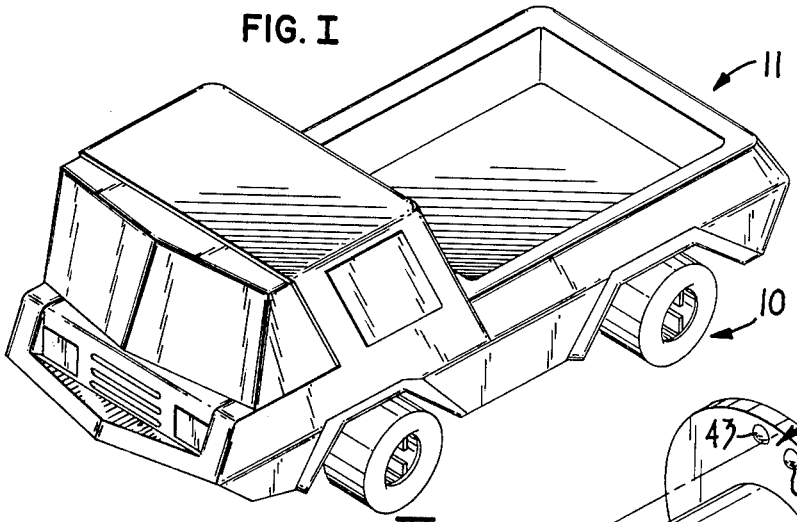
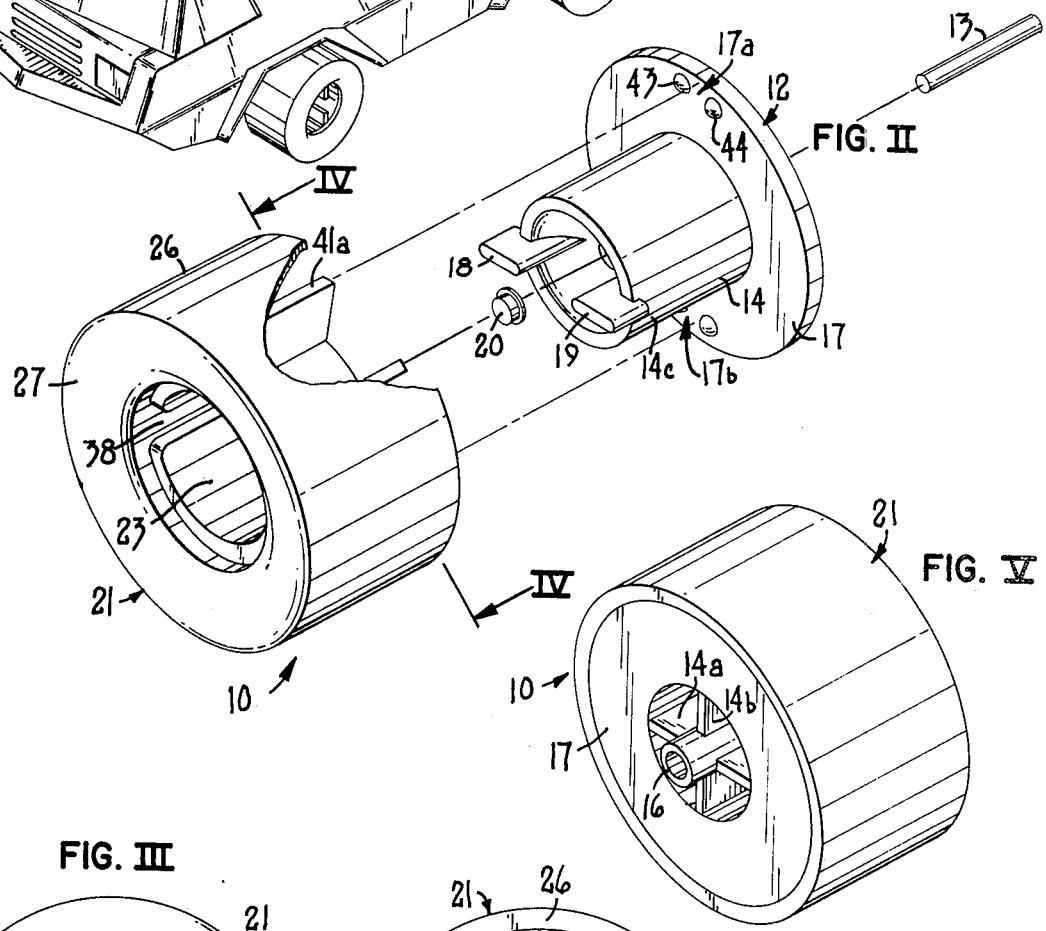
FIG. II
FIG. V
FIG. III
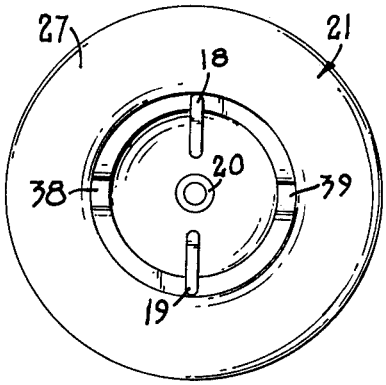
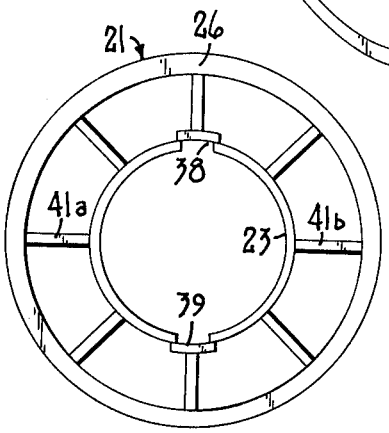
FIG. IV

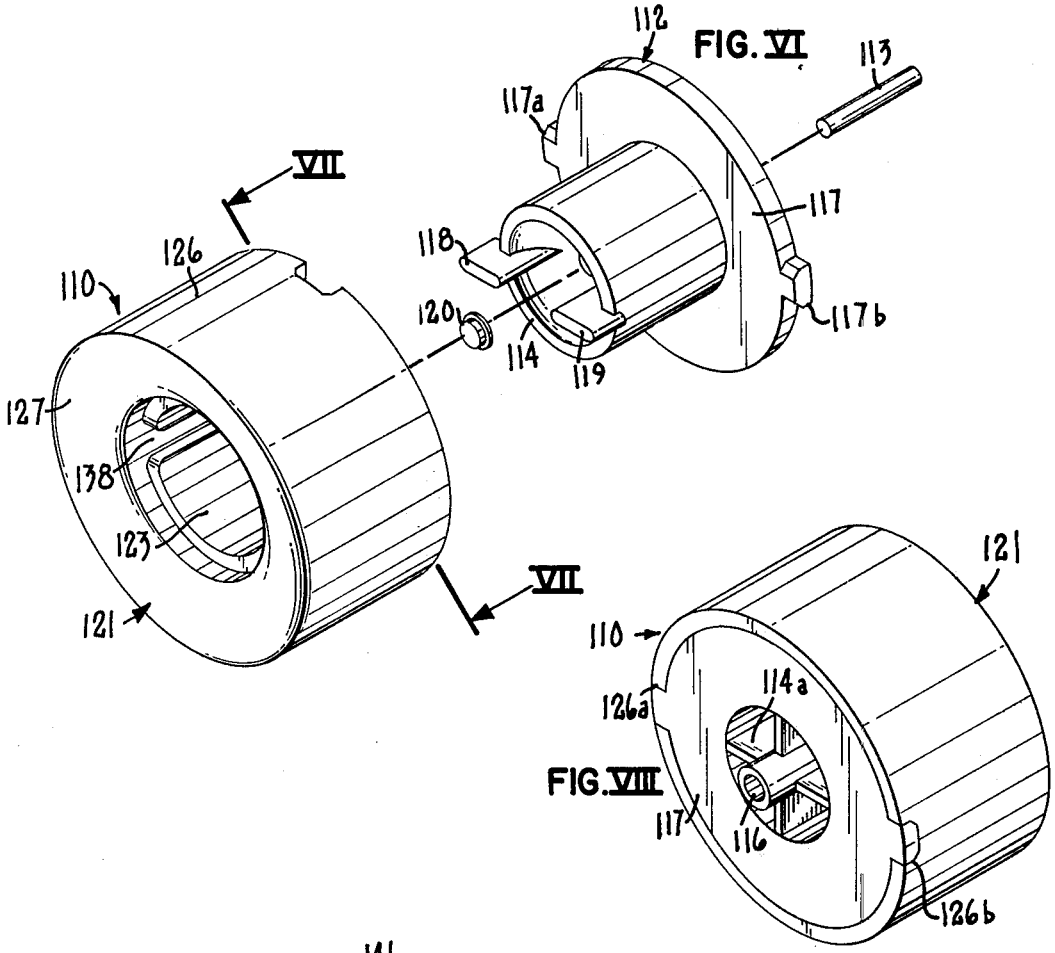
FIG. VI
FIG. VIII
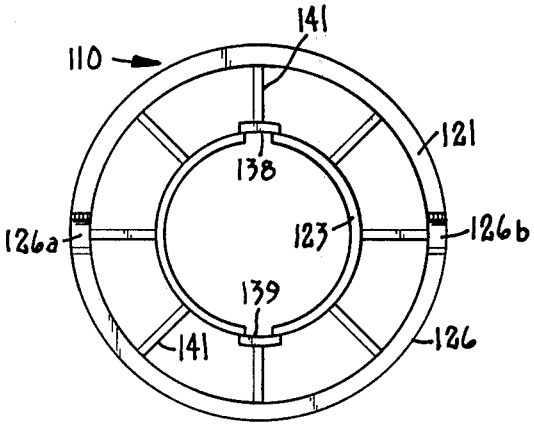
FIG. VII

MOUNTABLE WHEEL FOR TOY VEHICLE

BACKGROUND OF THE INVENTION

The present invention relates to toy non-riding vehicles and more particularly relates to a demountable wheel for use on such toy vehicles.

A wide variety of wheels have been proposed in the past for use on toy vehicles. Early toy wheels, for example, were molded as a single piece and often constructed either of rubber or metal. Later, such wheels were molded of polyethylene of other plastics. At various times, improvements were made to such single piece, molded wheels. For example, U.S. Pat. No. 2,940,781 discloses mounting of a hub cap on such a single piece molded wheel.

Another type of wheel construction suggested for use on toy vehicles included a hub such as of a plastic material and a rubber tire mounted over such hub. Illustrative of these toy wheels is that shown in U.S. Pat. No. 3,604,756.

Known wheels have generally been permanently mounted on the axle in toy vehicles. Permanent mounting has been provided in many instances by deforming the ends of the axles subsequent to mounting the wheel thereon. In other instances, washers and/or keys have been used to lock the wheel on the axle. The washer and key arrangement is disclosed in U.S. Pat. No. 3,907,370. A common approach for securing wheels on axles in toy vehicles has been the use of a cap-like member which securely snaps over the end of the axle after the wheel is in place. Such cap-like members typically are difficult to remove.

One toy vehicle having demountable wheels is disclosed in U.S. Pat. No. 3,924,352. The toy vehicle there disclosed has wheels which are mounted on a hub utilizing a threaded engagement of a nut. The toy vehicle is provided with a small electrically powered wrench for removing the nut. The demountable wheel adds a dimension to the play value of toy vehicles since now the child may mount and remove the tire much as the child's parent may mount or remove the wheels on the family automobile.

Mounting of a toy vehicle wheel utilizing a nut has certain inherent disadvantages. For example, the nut requires special tools to enable the child to mount and remove the tire. Further, a nut may become too tightly secured in place and the child finds it difficult or impossible to remove the nut.

GENERAL DESCRIPTION OF THE PRESENT INVENTION

The present invention provides a toy wheel which has a tire that may be easily mounted or removed with no special tools required. The present invention provides a wheel in which the tire may be uniformly removed regardless of the number of times the tire is removed.

The present invention relates to a wheel suitable for use on toy vehicles and including a first wheel member which is rotatably mounted on a toy axle in a permanent or semi-permanent arrangement. This first member may comprise the entire hub of the toy wheel or may alternatively be a spindle on which the hub of the toy wheel may be mounted. In either case, the first member may include a flange or flanges which serve to hold the remainder of the wheel in place when in the mounted condition.

The toy wheel has a second member which includes the tire portion and may also include a tire hub in certain instances. The second member includes a slot or slots through which the aforementioned flange or flanges may be inserted with the flanges extending beyond the adjacent surfaces of the second wheel member. The second member is locked on the first member by rotating the second member a partial turn with respect to the first member. The first member may have a pair of limiting projections which cooperate with a portion of the second member to limit the rotation of the second member with respect to the first member. The present invention may be further understood by consideration of the following drawings and associated description.

IN THE DRAWINGS

FIG. I is a perspective view of a toy vehicle including the wheel of the present invention;

FIG. II is an exploded view of the wheel of the present invention;

FIG. III is a plan view of the side of the wheel of the present invention;

FIG. IV is a plan view of the tire of the present wheel structure take along the line IV—IV in FIG. II; and FIG. V is a perspective view of the present invention from the back side;

FIG. VI is an exploded perspective view of an alternate embodiment of the present invention;

FIG. VII is a view taken along the line VII—VII in FIG. VI;

FIG. VIII is a perspective view of the assembled wheel of FIG. VI.

DETAILED DESCRIPTION OF THE PRESENT INVENTION

The wheel 10 (FIG. I) of the present invention may be utilized on any of various toy vehicles such as the pickup truck 11. Although the wheel 10 is shown in conjunction with a pickup truck, it is to be recognized that the present wheel may be used in conjunction with various other vehicles such as toy passenger cars, vans, gravel trucks, farm tractors and the like.

The toy wheel 10, as shown in FIGS. II–V, may include a first member or hub 12 which is adapted for permanent or semi-permanent mounting on an axle 13 in rotatable engagement therewith. The member 12 may be secured on the axle 13 by conventional means such as a key or a cap-like locking device 20 which permits the member 12 to rotate on the axle 13 but prevents the member 12 from being removed from the axle 13.

The member 12 may be a spindle including a cylindrical portion 14. A plurality of rib-like structures such as **14*a* and 14*b*, outer cylindrical wall portion 14*c* and a cylindrically shaped inner portion 16 for reception of the axle are provided in portion 14. Member 12 further includes a disc-like portion 17 which may be integral with portion 14. Portion 17** is slightly flexible and acts as a spring.

Portion 17 has at least one and preferably two sets of locking projections such as **17*a* and 17*b*. Each set may include two spaced projections 43 and 44. Member 12 has a pair of flanges or ears 18 and 19 which also are integral with member 14. The member 12** may be formed by any suitable method such as by injection molding of a thermal plastic material.

The wheel 10 has a second member 21 which resembles a tire and includes an inner wall 23, an outer wall 26 and a side wall 27. The tire portion 21 includes a pair of slot-like recesses 38 and 39 defined in inner wall 23. A plurality of rib-like portions or gussets 41 extend radially from wall 23 to wall 26.

The tire member 21 may be mounted upon hub member 12 by moving flanges 18 and 19 along the slot-like openings 38 and 39. Slight inward force on tire 21 forces the spring-like flange 17 inwardly and thereby permitting the flanges 18 and 19 to exit through openings 38 and 39. The tire member 21 is then rotated with respect to member 12 until each one of a pair of gussets such as 41*a* and 41*b* lie between the projections sets 17*a* and 17*b*. In other words, the gusset 41*a* is snapped passed projection 43 of set 17*a* and lies trapped between projections 43 and 44. The inward pressure is then released and member 21 is held between flanges 18, and 19 and flange 17. The tire member 21 is thus locked with respect to member 12.

The tire 21 may be removed by applying inward pressure and rotating to forcibly move gussets 41 passed projection sets 17*a* and 17*b* until flanges 18 and 19 correspond or align with the slot-like openings 38 and 39. The tire 21 may then be pulled outwardly thereby separating the tire 21 from the hub member 12.

An alternate embodiment 110 of the present invention is illustrated in FIGS. VI–VIII. The toy wheel 110 may include a first member or hub 112 which is adapted for permanent or semi-permanent mounting on an axle 113. Member 112 is rotatable with respect to the axle 113. The member 112 may include a cylindrical portion 114, a disc-like portion 117, and a pair of flanges or ears 118 and 119. The disc-like portion 117 has a pair of radially extending projections 117*a* and 117*b*. The projections 117*a* and 117*b* may have bevelled edges substantially as shown in FIG. VIII. The bevelled edges are for purposes hereinafter described.

The wheel 110 has a second member 121 which resembles a tire and includes an inner wall 123, an outer wall 126 and a side wall 127. A plurality of gussets 141 extend between wall 123 and wall 126. A pair of slot-like recesses 138 and 139 are provided in member 121. The slots 138 and 139 are of a size suitable to receive the ears 118, 119 therealong as the member 121 is slid over the member 112. The wall 126 has a pair of recesses 126*a* and 126*b* of a size and shape to cooperate with the projections 117*a* and 117*b* to releasibly lock member 112 with respect to member 121. Thereby limiting or preventing accidental rotation between such members. The sides of the slots 126*a* and 126*b* are bevelled to facilitate rotation of one member with regard to the other when one desires to demount the tire 121 from the hub 112.

Various modifications can be made without departing from the broader scope of the present invention as defined in the following claims. For example, the flanges 18 and 19 may be replaced with a single flange or alternatively with three or more flanges providing corresponding openings are provided in tire 21.

What is claimed is:

1. An easily mountable and demountable wheel for use on toy vehicles, said wheel comprising:

a. first wheel hub means adapted for rotatable mounting on an axle, said first wheel hub means including a cylindrical portion, a resilient, radially-extending disc-like portion disposed at one end of said cylindrical portion and laterally-extending flange means disposed at the other end of said cylindrical portion, said laterally-extending flange means being axially aligned with said cylindrical portion, said disc-like portion including first snap lock means; and b. second wheel means having a portion simulating a tire, said second wheel means having a cylindrical opening defined therein for reception of the cylindrical portion of said first wheel hub means, said opening including recessed portions through which said flange means may axially move when mounting and demounting said second wheel means from said first wheel means, said second wheel means including second lock means for cooperation with the first lock means to prevent unintended rotation of said second wheel means with respect to said first wheel means, whereby said second wheel means may be held on said first wheel means entrapped between said flange means and said disc-like portion.

2. The wheel of claim 1 wherein said first lock means comprise at least a pair of axially extending projections on said disc-like portion which cooperate with said second lock means rotatably to lock said first and second members.

3. The wheel of claim 2 wherein said second lock means comprise a rib-like member which is adapted to be releasibly trapped between said pair of projections.

4. The wheel of claim 1 wherein said first lock means comprise at least one radially extending projection which engages the second lock means to rotatably lock said first and second members.

5. The wheel of claim 4 wherein said second lock means comprise a slot in said second wheel means, said radially extending projection being adapted to snap into said slot to rotatably lock said members.

6. The wheel of claim 5 wherein said first lock means comprise a pair of radially extending projections.

7. The wheel of claim 5 wherein said projection has a bevelled edge to facilitate movement of said projection into and out of said slot.

8. A wheel and axle structure for use on toy vehicles, said wheel and axle structure comprising:

an axle;

a spindle permanently mounted on said axle for rotatable engagement therewith, said spindle including a cylindrical portion, a plurality of outwardly extending ears adjacent one end of said cylindrical portion and a disc-like portion extending outwardly adjacent the other end of said cylindrical portion, said disc-like portion being resiliently flexible to serve as spring means, said disc-like portion including locking projections extending therefrom;

means for permanently securing said spindle on said axle; and wheel means including a tire portion and a hub portion, said hub portion having a cylindrical opening defined in the center thereof for reception of said spindle, said hub further including a plurality of slot-like openings through which said ears may pass, said wheel means including recesses in whch said locking projections may lie to rotatably lock said spindle and said wheel means, whereby said spindle is permanently mounted for rotation on said axle and said wheel means are removably mounted on said spindle by aligning the cylindrical opening in the hub portion with the cylindrical portion of the spindle and aligning the slot-like openings in said hub with the ears of said spindle, sliding said wheel means axially onto said spindle resiliently deforming said disc-like portion to urge said ears axially outwardly of said hub, rotating said wheel means until said projections align with said recesses and releasing said wheel means to a locked position with said projections lying in said recesses.

* * * * *